US006767408B2

(12) United States Patent
Kenowski et al.

(10) Patent No.: US 6,767,408 B2
(45) Date of Patent: Jul. 27, 2004

(54) MONITORING DEVICE AND METHOD FOR OPERATING CLEAN-IN-PLACE SYSTEM

(75) Inventors: Andy Kenowski, Waukesha, WI (US); Leo F. Bohanon, Oconomowoc, WI (US)

(73) Assignee: Hydrite Chemical Co., Brookfield, WI (US)

( * ) Notice: Subject to any disclaimer, the term of this patent is extended or adjusted under 35 U.S.C. 154(b) by 0 days.

(21) Appl. No.: 10/322,910

(22) Filed: Dec. 18, 2002

(65) Prior Publication Data

US 2004/0118432 A1 Jun. 24, 2004

(51) Int. Cl.[7] ..... B08B 3/00; B08B 3/04; B08B 9/093

(52) U.S. Cl. ..... 134/18; 134/22.1; 134/22.11; 134/22.12; 134/22.18; 134/26; 134/28; 134/29; 134/41; 134/56 R; 134/113

(58) Field of Search ..... 134/18, 22.1, 22.11, 134/22.12, 22.18, 26, 28, 29, 41, 56 R, 113

(56) References Cited

U.S. PATENT DOCUMENTS

| | | | |
|---|---|---|---|
| 2,897,829 | A | 8/1959 | Arrington et al. |
| 4,836,420 | A | 6/1989 | Kromrey |
| 5,047,164 | A | 9/1991 | Corby |
| 5,064,561 | A | 11/1991 | Rouillard |
| 5,282,889 | A | 2/1994 | Franklin |
| 5,348,058 | A | 9/1994 | Ruhl |
| 5,405,452 | A | 4/1995 | Anderson et al. |
| 5,427,126 | A | 6/1995 | Carney et al. |
| 5,533,552 | A | 7/1996 | Ahlers |
| 5,888,311 | A | 3/1999 | Laufenberg et al. |
| 6,071,356 | A | 6/2000 | Olsen |
| 6,089,242 | A | 7/2000 | Buck |
| 6,136,362 | A | 10/2000 | Ashton |
| 6,161,558 | A | 12/2000 | Franks et al. |
| 6,391,122 | B1 | 5/2002 | Votteler et al. |
| 6,423,675 | B1 | 7/2002 | Coughlin et al. |

*Primary Examiner*—Zeinab El-Arini
(74) *Attorney, Agent, or Firm*—Quarles & Brady LLP

(57) ABSTRACT

A method for cleaning an apparatus using a clean-in-place system is disclosed. The clean-in-place system is in fluid communication with an inlet and an outlet of the apparatus. In the method, a cleaning composition having a measurable physical property (e.g., pH) is supplied from a cleaner tank into the inlet of the apparatus for a first period of time. A rinsing composition having the measurable physical property at a second measured value is then supplied from a rinse tank into the inlet of the apparatus for a second period of time. The measurable physical property is sensed versus time for fluids exiting the outlet of the apparatus, and a circulation time of the cleaning composition is determined. A closing time for a return valve of the cleaner tank is then determined for subsequent cleaning cycles such that minimal rinsing composition enters the cleaner tank during the subsequent cleaning cycle.

22 Claims, 2 Drawing Sheets

MONITORING DEVICE AND METHOD FOR OPERATING CLEAN-IN-PLACE SYSTEM

CROSS REFERENCES TO RELATED APPLICATIONS

Not applicable.

STATEMENT REGARDING FEDERALLY SPONSORED RESEARCH

Not applicable.

BACKGROUND OF THE INVENTION

1. Field of the Invention

The present invention relates to a device and methods for operating a clean-in-place system, and more particularly to a monitoring device and monitoring methods that optimize the control sequence of the inlet valves and the outlet valves of the fluid storage tanks and the waste disposal lines of a clean-in-place system.

2. Description of the Related Art

Food processing equipment, such as that found in dairies, breweries, and carbonated beverage plants, typically includes tanks, pumps, valves and fluid piping. This food processing equipment often needs to be cleaned between each lot of product processed through the equipment. However, the tanks, pumps, valves and piping can be difficult to clean because the various components may be difficult to access and disassemble for cleaning. Because of these cleaning difficulties, many food processing plants now use clean-in-place systems in which the tanks, pumps, valves and piping of the food processing equipment remain physically assembled, and various cleaning, disinfecting and rinsing solutions are circulated by the clean-in-place system through the food processing equipment to effect the cleaning process.

An example clean-in-place cleaning cycle normally begins with a pre-rinse cycle wherein water is pumped through the food processing equipment for the purpose of removing loose soil in the system. Typically, an alkaline wash would then be recirculated through the food processing equipment. This alkaline wash would chemically react with the soils of the food processing equipment to further remove soil. A third step would again rinse the food processing equipment with water, prior to a fourth step wherein an acid rinse would be circulated through the batch processing system. The acid rinse would neutralize and remove residual alkaline cleaner and remove any mineral deposits left by the water. Finally, a post-rinse cycle would be performed, typically using water and/or a sanitizing rinse. Such clean-in-place systems (and associated cleaning compositions) are known in the art, and examples can be found in U.S. Pat. Nos. 6,423,675, 6,391,122, 6,161,558, 6,136,362, 6,089,242, 6,071,356, 5,888,311, 5,533,552, 5,427,126, 5,405,452, 5,348,058, 5,282,889, 5,064,561, 5,047,164, 4,836,420, and 2,897,829, which are incorporated herein by reference.

While known clean-in-place systems have proven to be effective in cleaning the components of food processing equipment, they are not without drawbacks. Typically, fluid flow in a clean-in-place system is controlled by a programmable logic controller that controls activation of the clean-in-place system valves. Typically, the PLC programmer configures the software in the PLC to provide "open" and "close" signals to the valves to achieve a predetermined wash or rinse time. These wash or rinse times are typically based on estimated piping lengths in the apparatus being cleaned.

The use of estimated pipe lengths in the PLC programming can cause problems in operation of the clean-in-place system. For example, the rinse steps in the clean-in-place process may be of insufficient duration to clean solids from the apparatus being cleaned. Improper calculation of the duration of rinse times can lead to higher water or sewer charges, and may also lead to the introduction of rinse water to cleaning composition tanks thereby diluting the cleaning composition in the tanks. Improper calculation of the duration of the various steps in the clean-in-place process can also lead to introduction of caustic or acidic compositions to the clean-in-place system drain, which may be undesirable in view of environmental restrictions.

Thus, there is a need for a monitoring device and monitoring methods that optimize the control sequence of the inlet valves and the outlet valves of the fluid storage tanks and the waste disposal lines of a clean-in-place system. In particular, there is a need for a monitoring device and monitoring methods for a clean-in-place system wherein the device and methods improve the cleaning of solids from the apparatus being cleaned, minimize water or sewer charges, limit the introduction of caustic or acidic compositions to the clean-in-place system drain, and limit the introduction of rinse water to the clean-in-place system cleaning composition tanks.

SUMMARY OF THE INVENTION

The present invention satisfies the foregoing needs by providing a method for cleaning an apparatus using a clean-in-place system wherein the clean-in-place system is in fluid communication with an inlet of the apparatus and the clean-in-place system is in fluid communication with an outlet of the apparatus. In the method, a cleaning composition is supplied from a cleaner tank of the clean-in-place system into the inlet of the apparatus for a first period of time of a first cleaning cycle. The cleaning composition has a measurable physical property (e.g., flow rate, pH, conductivity, turbidity, suspended solids, concentration, density and temperature) at a first measured value. The cleaner tank has a cleaner supply valve and a cleaner return valve such that the cleaning composition may be recirculated through the cleaner tank and the apparatus.

A rinsing composition from a rinse tank of the clean-in-place system is supplied into the inlet of the apparatus for a second period of time of the first cleaning cycle. The rinsing composition has the measurable physical property at a second measured value different from the first measured value of the cleaning composition. The measurable physical property is sensed versus time for fluids exiting the outlet of the apparatus, and a circulation time of the cleaning composition from a predetermined time of the first period of time of the first cleaning cycle to an end time wherein the measurable physical property of the fluids has a third measured value different from the first measured value is determined. This provides for the location as a function to time of an interface between the cleaning composition and the rinsing composition. A cleaner return valve closing time for closing the cleaner return valve is then determined in dependence on the circulation time. The cleaner return valve closing time is then used after supplying the cleaning composition from the cleaner tank and thereafter supplying the rinsing composition from the rinse tank in a subsequent cleaning cycle. Preferably, the cleaner return valve closing time is selected such that no rinsing composition enters the cleaner tank during the subsequent cleaning cycle.

In another aspect of the present invention, the measurable physical property is sensed versus time for fluids exiting the outlet of the apparatus, and a circulation time of the cleaning composition from a predetermined time of the first period of time of the first cleaning cycle to an end time wherein the measurable physical property of the fluids has a third measured value different from the first measured value is determined. This provides for the location as a function to time of an interface between the cleaning composition and the rinsing composition. A drain valve closing time for closing a drain valve of the clean-in-place system is then determined in dependence on the circulation time. The drain valve closing time is then used after supplying the cleaning composition from the cleaner tank and thereafter supplying the rinsing composition from the rinse tank in a subsequent cleaning cycle. Preferably, the drain valve closing time is selected such that no cleaning composition enters the drain during the subsequent cleaning cycle.

In yet another aspect of the present invention, a rinsing composition is supplied from a rinse tank of the clean-in-place system into the inlet of the apparatus for a period of time. The rinsing composition has a measurable physical property at a first measured value. The rinse tank has a rinse supply valve and is in fluid communication with a drain or a solids recovery tank of the clean-in-place system. The measurable physical property is sensed versus time for fluids exiting the outlet of the apparatus, and a circulation time of the rinsing composition from a predetermined time of the period of time in which the rinsing composition is supplied from the rinse tank of the clean-in-place system into the inlet of the apparatus to an end time wherein the measurable physical property of the fluids is approximately the first measured value is determined. A rinsing time for opening the rinse supply valve and supplying the rinsing composition from the rinse tank in a subsequent cleaning cycle is then determined in dependence on the determined circulation time. Preferably, the rinsing time is selected such that substantially all loose solids present in passageways of the apparatus enter the drain or the solids recovery tank during the subsequent cleaning cycle.

In still another aspect of the invention, there is provided a clean-in-place system for cleaning an apparatus. The system includes a tank containing a fluid composition having a measurable physical property at a first measured value. The tank has a supply valve and a return valve. A fluid supply conduit connects the supply valve of the tank and an inlet of the apparatus, and a fluid return conduit connects the return valve of the tank and an outlet of the apparatus. A sensor is located in the fluid return conduit for repeatedly sensing the measurable physical property of fluids passing through the fluid return conduit and for generating a physical property signal corresponding to each sensed measurable physical property. A system controller is responsive to physical property signals from the sensor and provides control signals to the supply valve and the return valve. The controller executes a stored program to open the supply valve and the return valve to circulate the fluid composition through the tank and the apparatus, compare successive physical property signals from the sensor, and close the return valve at a time after successive physical property signals have a deviation greater than a predetermined amount. Optionally, the system further includes a second tank containing a second fluid composition having the measurable physical property at a second measured value. The second tank also has a supply valve and a return valve. In embodiment, the controller executes a stored program to open the supply valve and the return valve of the tank to circulate the fluid composition through the tank and the apparatus, close the supply valve of the tank and open the supply valve of the second tank to circulate the second fluid composition through the tank and the apparatus, compare successive physical property signals from the sensor, and close the return valve of the tank at a time after physical property signals correspond to the second measure value. In another embodiment, the sensor in the fluid return conduit repeatedly senses the pH and flow rate of fluids passing through the fluid return conduit and generates a physical property signal corresponding to each sensed measurable physical property, and the controller executes a stored program to open the supply valve and the return valve of the tank to circulate the fluid composition through the tank and the apparatus, compare successive pH signals from the sensor, and close the return valve of the tank at a time after the pH signals have a deviation greater than a predetermined amount, the time being calculated in dependence on the sensed flow rate.

It is thus an advantage of the present invention to provide a monitoring device and monitoring methods for a clean-in-place system wherein the device and methods limit the introduction of caustic or acidic compositions to the clean-in-place system drain.

It is another advantage of the present invention to provide a monitoring device and monitoring methods for a clean-in-place system wherein the device and methods limit the introduction of rinse water to the clean-in-place system cleaning composition tanks.

It is yet another advantage of the present invention to provide a monitoring device and monitoring methods for a clean-in-place system wherein the device and methods minimize water or sewer charges for the clean-in-place system.

It is still another advantage of the present invention to provide a monitoring device and monitoring methods for a clean-in-place system wherein the device and methods improve the cleaning of solids from the apparatus being cleaned.

These and other features, aspects, and advantages of the present invention will become better understood upon consideration of the following detailed description, appended claims and accompanying drawings.

BRIEF DESCRIPTION OF THE DRAWINGS

Like reference numerals will be used to refer to like or similar parts from Figure to Figure in the following description of the drawings.

DETAILED DESCRIPTION OF THE INVENTION

Figure 1:
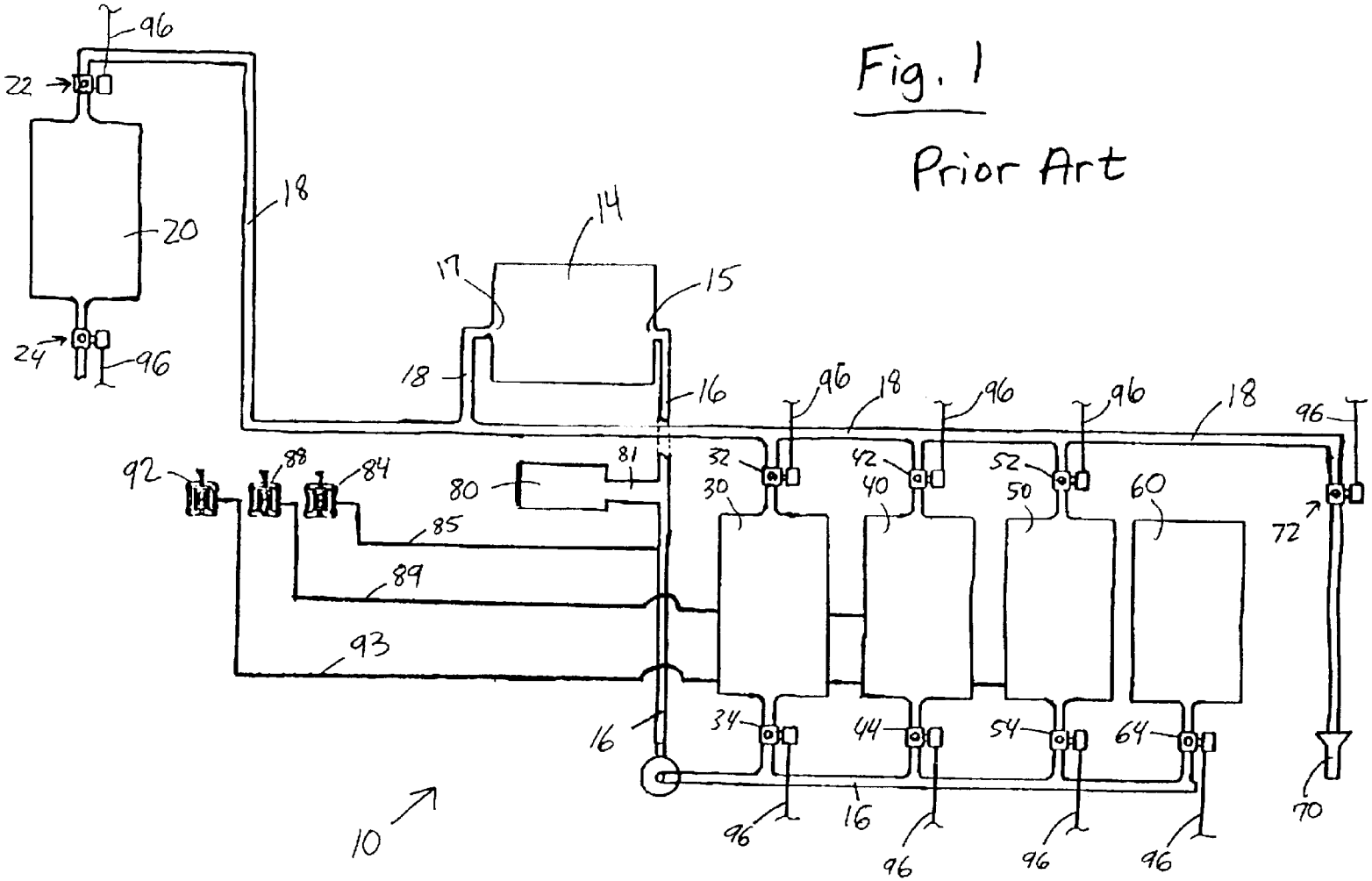
Fig. 1 Prior Art
FIG. 1 is a schematic of one version of a conventional clean-in-place system.

In order to provide background for the present invention, the arrangement and operation of one version of a conventional clean-in-place system will be described with reference to FIG. 1. The clean-in-place system, indicated generally at 10, is used to clean an apparatus, indicated generally at 14. The apparatus 14 may be, for example, food processing equipment, such as that found in dairies, breweries, and carbonated beverage plants, which typically includes tanks, pumps, valves and fluid piping. The apparatus 14 to be cleaned by the clean-in-place system 10 is not limited to this type of equipment but may be any apparatus that can be cleaned by moving fluids through the apparatus.

The clean-in-place system 10 includes a high solids tank 20, a recovery tank 30, a caustic tank 40, an acid tank 50, and a rinse tank 60. The high solids tank 20 is typically used to contain solids recovered from the apparatus 14 during the cleaning process as will be described below. The recovery tank 30 is typically used to contain recovered rinse solution from the clean-in-place process as will be described below. The caustic tank 40 typically contains an alkaline cleaning solution used in the clean-in-place process, and suitable alkaline cleaning solutions are well known and commercially available. The acid tank 50 typically contains an acidic cleaning solution used in the clean-in-place process, and suitable acidic cleaning solutions are well known and commercially available. The rinse tank 60 contains a rinsing composition used in the clean-in-place process, and in many clean-in-place systems, the rinsing composition is water.

The high solids tank 20, the recovery tank 30, the caustic tank 40, the acid tank 50 and the rinse tank 60 are placed in fluid communication in the clean-in-place system 10 and with the apparatus 14 by way of various conduits and valves. The clean-in-place system 10 includes a fluid supply conduit 16 that is connected to an inlet 15 of the apparatus 14. The fluid supply conduit 16 of the clean-in-place system 10 is also connected to the recovery tank 30, the caustic tank 40, the acid tank 50 and the rinse tank 60 through a recovery supply valve 34, a caustic supply valve 44, an acid supply valve 54 and a rinse supply valve 64, respectively. The fluid supply conduit 16 of the clean-in-place system 10 is also connected to an air source 80 by way of an air conduit 85, and to a sanitizer pump 84 by way of a sanitizer conduit 81. The sanitizer pump 84 provides a sanitizing composition to the fluid supply conduit 16 as described below.

The clean-in-place system 10 also includes a fluid return conduit 18 that is connected to an outlet 17 of the apparatus 14. The fluid return conduit 18 of the clean-in-place system 10 is also connected to the high solids tank 20, the recovery tank 30, the caustic tank 40, and the acid tank 50 through a high solids fill valve 22, a recovery fill valve 32, a caustic return valve 42 and an acid return valve 52. The fluid return conduit 18 of the clean-in-place system 10 is also connected to a clean-in-place system drain 70. A drain valve 72 may be provided to control fluid flow from the fluid return conduit 18 of the clean-in-place system 10 to the drain 70.

The clean-in-place system 10 also includes a caustic pump 88 that provides alkaline cleaning solution to the caustic tank 40 by way of a caustic conduit 89. An acid pump 92 is also provided to pump acidic cleaning solution to the acid tank 50 by way of an acid conduit 93. The high solids tank 20 also includes a high solids outlet valve 24 that provides a means to remove solids from the high solids tank 20. The valves of the clean-in-place system 10 are actuated using known means such as a compressed air line 96 controlled by a programmable logic controller (not shown).

Having described the construction of the clean-in-place system 10, the operation of the clean-in-place system 10 can now be described. After the apparatus 14 has completed one or more processes (such as a batch fluid packaging process), the clean-in-place system 10 is activated to clean and/or disinfect the apparatus 14. Generally, fluid flow in the clean-in-place system 10 is controlled by a programmable logic controller (PLC) that controls activation of the clean-in-place system valves by way of compressed air line 96 under PLC control. Such programmable logic controllers are commercially available from Rockwell Automation, Milwaukee, Wis.

In a first step of the clean-in-place process, often termed "product push", the rinse supply valve 64 is opened to push the residual product remaining in the apparatus 14 toward the outlet 17 of the apparatus 14 by way of the rinsing composition (e.g., water) in the rinse tank 60. In a next step called a "high solids rinse", the rinse supply valve 64 remains open and the high solids fill valve 22 is opened to allow solids in the apparatus 14 to be pushed into the high solids tank 20 by way of the rinse water. In a subsequent "first rinse" step, the rinse supply valve 64 remains open, the high solids fill valve 22 is closed, and the drain valve 72 is opened to allow rinse water (and often some suspended or dissolved solids) to be pushed into the drain 70 by way of rinse water. In a next step called a "rinse push", the caustic supply valve 44 is opened, the caustic return valve 42 remains closed, and the drain valve 72 remains open, thereby pushing further amounts of the rinse water into the drain 70 by way of the alkaline cleaning solution from the caustic tank 40.

In a following "caustic wash" step, the caustic supply valve 44 remains open, the caustic return valve 42 is opened, and the drain valve 72 is closed such that alkaline cleaning solution is circulated and recirculated through the clean-in-place system 10 and the apparatus 14. Various compositions are suitable as the alkaline cleaning solution, and typically these alkaline solutions react with fatty acids in organic soils in the apparatus 14 to produce a salt by way of an acid-base reaction. The consumption of the alkaline cleaning solution in such acid-base reactions causes a drop in the alkalinity of the alkaline cleaning solution. To compensate for the drop in alkalinity, additional alkaline cleaning solution may be added to the caustic tank 40 by the caustic pump 88. Often, conductivity or pH sensors are used to monitor the alkalinity of the alkaline cleaning solution in the caustic tank 40, and feedback from the sensors to the PLC signals the PLC to initiate delivery of alkaline cleaning solution from the caustic pump 88 to the caustic tank 40. Such delivery may be during or after the clean-in-place process.

In a next step called "caustic rinse push", the rinse supply valve 64 is opened, the caustic return valve 42 remains open, and the caustic supply valve 44 is closed, thereby pushing the alkaline cleaning solution in the clean-in-place system 10 and the apparatus 14 into the caustic tank 40. In a following step called "recovery tank fill", the rinse supply valve 64 remains open, the caustic return valve 42 is closed, the recovery tank fill valve 32 is opened, and the drain valve 72 remains closed, thereby pushing rinse water into the recovery tank 30. The used rinse water in the recovery tank 30 may be used in subsequent rinsing steps. In a subsequent step called "caustic rinse", the rinse supply valve 64 remains open, the recovery tank fill valve 32 is closed, and the drain valve 72 is opened, thereby sending rinse water (and suspended or dissolved solids) to the drain 70. In a following step called "rinse push", the rinse supply valve 64 is closed, the acid supply valve 54 is opened, the acid return valve 52 remains closed and the drain valve 72 remains open, thereby pushing further rinse water (and suspended or dissolved solids) to drain 70.

In a following "acid wash" step, the acid supply valve 54 remains open, the acid return valve 52 is opened, and the drain valve 72 is closed such that acidic cleaning solution is circulated and recirculated through the clean-in-place system 10 and the apparatus 14. Various compositions are suitable as the acidic cleaning solution, and typically these acidic solutions react with basic materials (e.g., minerals) in the apparatus 14 to produce a salt by way of an acid-base reaction. The consumption of the acidic cleaning solution in such acid-base reactions causes a drop in the acidity of the acidic cleaning solution. To compensate for the drop in acidity, additional acidic cleaning solution may be added to the acid tank 50 by the acid pump 92. Often, conductivity or pH sensors are used to monitor the acidity of the acidic cleaning solution in the acid tank 50, and feedback from the sensors to the PLC signals the PLC to initiate delivery of acidic cleaning solution from the acid pump 92 to the acid tank 50. Such delivery may be during or after the clean-in-place process.

In a next step called "acid rinse push", the rinse supply valve 64 is opened, the acid return valve 52 remains open, and the acid supply valve 54 is closed, thereby pushing the acidic cleaning solution in the clean-in-place system 10 and the apparatus 14 into the acid tank 50. In a following step called "acid rinse", the rinse supply valve 64 remains open, the acid return valve 52 is closed, and the drain valve 72 is opened, thereby sending rinse water (and suspended or dissolved solids) to the drain 70.

In a following step called "sanitize", the rinse supply valve 64 remains open, the drain valve 72 remains open, and the PLC initiates delivery of sanitizer from the sanitizer pump 84 by way of the sanitizer conduit 81 to the fluid supply conduit 16. The rinse water including the injected sanitizer is circulated through the clean-in-place system 10 and the apparatus 14, and is sent to drain 70. In a next step called "sanitizer push", sanitizer injected is stopped, the rinse supply valve 64 remains open and the drain valve 72 remains open thereby pushing the remaining sanitizer/water mixture to drain 70. In a following step called "air blow", the rinse supply valve 64 is closed, the drain valve 72 remains open, and the PLC initiates delivery of air from the air source 80 to the air conduit 81 and to the fluid supply conduit 16. The air pushes further fluids remaining in the clean-in-place system 10 and the apparatus 14 to drain 70. The clean-in-place process is then complete.

It should be understood that the arrangement and operation of the clean-in-place system of FIG. 1 have been described for background context for the present invention. Numerous modifications of the clean-in-place system of FIG. 1 are possible. Several non-limiting examples of modifications of the clean-in-place system of FIG. 1 include: (1) the clean-in-place system of FIG. 1 wherein the high solids tank 20 and the recovery tank 30 are removed; (2) a clean-in-place system having either a caustic tank 40 or an acid tank, a rinse tank 60, no high solids tank 20, and no recovery tank 30; (3) the clean-in-place system of FIG. 1 wherein the drain valve 72 is removed and entry of fluids into the drain 70 is controlled by the recovery fill valve 32, the caustic return valve 42 or the acid return valve 52; (4) the clean-in-place system of FIG. 1 wherein various fluid "pushing" processes (e.g., "caustic rinse push" or "acid rinse push") are executed by way of air from the air source 80 rather than liquids from the caustic tank 40, the acid tank 50, and/or the rinse tank 60; and (5) the clean-in-place system of FIG. 1 wherein the high solids tank 20 is removed.

Having described the construction and operation of the conventional clean-in-place system 10 shown in FIG. 1, some drawbacks and disadvantages of such a conventional clean-in-place system can be highlighted. As detailed above, fluid flow in the clean-in-place system 10 is controlled by a programmable logic controller that controls activation of the clean-in-place system valves. Typically, the PLC programmer configures the software in the PLC to provide "open" and "close" signals to the valves to achieve a predetermined wash or rinse time. These wash or rinse times are typically based on estimated piping lengths in the apparatus being cleaned.

The use of estimated pipe lengths in the PLC programming can cause problems in operation of the clean-in-place system. For example, the "first rinse" and the "rinse push" steps described above may be of insufficient duration to clean solids from the apparatus 14. As a result, excessive solids may be returned to the caustic tank 40 during the "caustic wash" step. The excessive solids can cause elevated readings in the conductivity sensors in the caustic tank 40 thereby postponing the delivery of alkaline cleaning solution from the caustic pump 88 to the caustic tank 40 when more alkaline cleaning solution is actually needed in the caustic tank 40. Improper calculation of the duration of the various steps in the clean-in-place process can also lead to introduction of caustic or acid to the drain, which may be undesirable in view of environmental restrictions. Improper calculation of the duration of rinse times can lead to higher water or sewer charges, and may also lead to the introduction of rinse water to the caustic tank 40 or the acid tank 50 thereby initiating early and excessive delivery of alkaline cleaning solution to the caustic tank 40 and early and excessive delivery of acidic cleaning solution to the acid tank 50. Thus, improved control of the fluid flow in the clean-in-place system 10 is needed.

Figure 2:
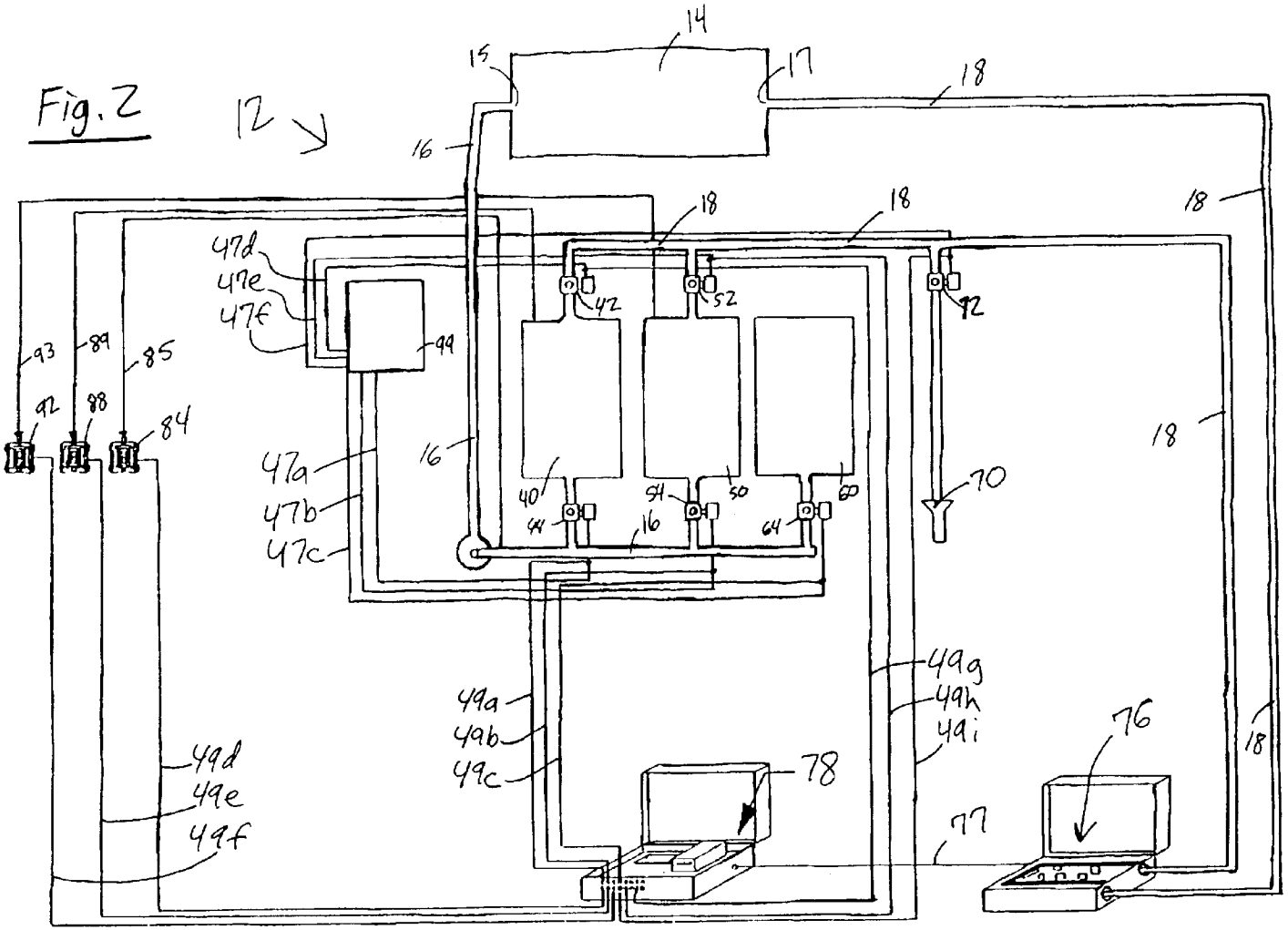
FIG. 2 is a schematic of a clean-in-place system in accordance with the invention.

Referring now to FIG. 2, a schematic of a clean-in-place system according to the invention, indicated generally at 12, is shown. The clean-in-place system 12 of FIG. 2 includes many of the components of the clean-in-place system of FIG. 1. However, the high solids tank 20 and the recovery tank 30 of FIG. 1 are not included in the illustrated version of the clean-in-place system 12 according to the invention shown in FIG. 2.

The clean-in-place system 12 of FIG. 2 includes a caustic tank 40, an acid tank 50, and a rinse tank 60. The caustic tank 40 typically contains an alkaline cleaning solution used in the clean-in-place process, and the acid tank 50 typically contains an acidic cleaning solution used in the clean-in-place process. The rinse tank 60 contains a rinsing composition used in the clean-in-place process, and in one embodiment, the rinsing composition is water. The caustic tank 40, the acid tank 50 and the rinse tank 60 are placed in fluid communication in the clean-in-place system 12 and with the apparatus 14 by way of various conduits and valves. The clean-in-place system 12 includes a fluid supply conduit 16 that is connected to the inlet 15 of the apparatus 14. The fluid supply conduit 16 of the clean-in-place system 12 is also connected to the caustic tank 40, the acid tank 50 and the rinse tank 60 through a caustic supply valve 44, an acid supply valve 54 and a rinse supply valve 64, respectively. The fluid supply conduit 16 of the clean-in-place system 12 is also connected to a sanitizer pump 84 by way of a sanitizer conduit 85. The sanitizer pump 84 provides a sanitizing composition to the fluid supply conduit 16.

The clean-in-place system 12 also includes a fluid return conduit 18 that is connected to the outlet 17 of the apparatus 14. The fluid return conduit 18 of the clean-in-place system 12 is also connected to the caustic tank 40, and the acid tank 50 through a caustic return valve 42 and an acid return valve 52. The fluid return conduit 18 of the clean-in-place system 12 is also connected to a clean-in-place system drain 70. A drain valve 72 is provided to control fluid flow from the fluid return conduit 18 of the clean-in-place system 12 to the drain 70.

The clean-in-place system 12 also includes a caustic pump 88 that provides alkaline cleaning solution to the caustic tank 40 by way of a caustic conduit 89. An acid pump 92 is also provided to pump acidic cleaning solution to the acid tank 50 by way of an acid conduit 93. The valves of the clean-in-place system 12 are actuated using compressed air by way of control signals provided by lines 47*a*, 47*b*, 47*c*, 47*d*, 47*e*, and 47*f* to the valves from a programmable logic controller 99. Fluid flow in the clean-in-place system 12 may be controlled by the programmable logic controller 99 using the "product push", "first rinse", "rinse push", "caustic wash", "caustic rinse push", "caustic rinse", "rinse push", "acid wash", "acid rinse push", and "sanitize" operation steps described above with reference to FIG. 1.

The clean-in-place system 12 of FIG. 2 further includes a sensor device 76 placed in the fluid return conduit 18 such that fluids passing through the fluid return conduit 18 pass through the sensor device 76. The sensor device 76 includes at least one sensor that measures a physical property of the fluids passing through the fluid return conduit 18. As used herein, a physical property or a measurable physical property is a property of matter that can be measured or observed without resulting in a change in the composition and identity of a substance. Non-limiting examples of physical properties that can be measured in the sensor device include flow rate, pH, conductivity, turbidity, suspended solids, concentration, density and temperature. Sensors are commercially available for measuring these physical properties of the fluids passing through the fluid return conduit 18.

The clean-in-place system 12 of FIG. 2 further includes a data processor 78 that is interfaced with the sensor device 76 by way of electrical connector 77. The data processor 78 includes software and suitable data storage means for recording signals received from the sensors in the sensor device. For example, the data processor 78 may be a lap top computer with software that collects and stores data from flow rate, pH, conductivity, turbidity, suspended solids, concentration, density and temperature sensors in the sensor device 76 as a function of time. The stored data may be viewed or printed out using well known data processing techniques.

The data processor 78 is also connected to sensors that provide air signals when any of the caustic return valve 42, the acid return valve 52, the drain valve 72, the caustic supply valve 44, the acid supply valve 54, the rinse supply valve 64, the sanitizer pump 84, the caustic pump 88 and the acid pump 92 are activated. Air lines 49*a*, 49*b*, 49*c*, 49*d*, 49*e*, 49*f*, 49*g*, 49*h*, and 49*i* provide these electrical signals to the data processor 78 for processing and storage of valve on and off signals as a function of time. Suitable sensors for valve activation are pressure sensors that provide an indication that air has been applied to a valve to open the valve. The software in the data processor 78 can convert valve activation signals into an indication of the clean-in-place operation step being undertaken as a function of time. For example, when the rinse supply valve 64 is open and the drain valve 72 is open, the software may indicate this time period as a "rinse" step. When the caustic supply valve 44 is open and the caustic return valve 42 is open, the software may indicate this time period as a "caustic wash" step. When the acid supply valve 54 is open and the acid return valve 52 is open, the software may indicate this time period as an "acid wash" step. Other time periods are determined using the valve positions for the operation steps described above with reference to FIG. 1.

Having described the construction of the clean-in-place system 12 of FIG. 2, the operation of the clean-in-place system 12 can now be described. After the apparatus 14 has completed one or more processes (such as a batch fluid packaging process), the clean-in-place system 12 is activated to clean and/or disinfect the apparatus 14. Fluid flow in the clean-in-place system 12 may be controlled by the programmable logic controller 99 using the "product push", "first rinse", "rinse push", "caustic wash", "caustic rinse push", "caustic rinse", "rinse push", "acid wash", "acid rinse push", and "sanitize" operation steps described above with reference to FIG. 1.

During the clean-in-place process, the data processor 78 records the opening and closing of the caustic return valve 42, the acid return valve 52, the drain valve 72, the caustic supply valve 44, the acid supply valve 54, and the rinse supply valve 64, and the activation and deactivation of the sanitizer pump 84, the caustic pump 88 and the acid pump 92 as a function of time. Also during the clean-in-place process, the data processor 78 records the measured value as a function of time of all physical properties of the fluid in the fluid return conduit 18 that are measured as the fluid passes through the sensor device 76. Typically, the sensor device 76 is located upstream of any valves returning solids to tanks or drain and is located as near as possible to the drain 70 of the clean-in-place system 12.

After a first cleaning cycle of the clean-in-place process, the data stored in the data processor 78 may be printed and analyzed. The data may provide as a function of time: (1) the operation step occurring during a certain time period (e.g., "caustic wash" step); (2) the measured physical properties for the fluid in the fluid return conduit 18 as measured when the fluid passes through the sensor device 76 (e.g., flow rate, pH, conductivity, turbidity, suspended solids, concentration, density and temperature); (3) the opening and closing of various valves; and (4) the activation of various pumps.

By analyzing the data stored in the data processor 78 after the first cleaning cycle of the clean-in-place process, subsequent cleaning cycles can be optimized. For example, in one example embodiment of the invention, an alkaline cleaning composition is supplied from the caustic tank 40 of the clean-in-place system 12 into the inlet 15 of the apparatus 14 during a "caustic wash" for a first period of time of a first cleaning cycle. The alkaline cleaning composition will have a measurable physical property (e.g., pH) at a first measured value (e.g., >7). The caustic tank 40 has the caustic supply valve 44 and the caustic return valve 42 open to allow the alkaline composition to recirculate through the caustic tank 40 and the apparatus 14. In a subsequent step, rinse water from the rinse tank 60 of the clean-in-place system 12 is introduced into the inlet 15 of the apparatus 14 for a second period of time of the first cleaning cycle. The rinse water has a measurable physical property (e.g., pH) at a second measured value (e.g., 7) that is different from the first measured value (e.g., pH >7) of the alkaline cleaning composition.

When the fluid in the fluid return conduit 18 is measured as the fluid passes through the sensor device 76, the interface between the alkaline cleaning composition and the rinse water can be identified by a drop in pH of the fluid. The time at which the interface passes through the sensor device 76 is also available in the data. In addition, the open and closed position of the caustic return valve 42 and the drain valve 72 can be read from the data. By comparing the times at which the interface between the alkaline cleaning composition and the rinse water passes through the sensor device 76 and the times at which the caustic return valve 42 and the drain valve 72 are open ands closed, one can determine where the alkaline cleaning composition and the rinse water end up in the clean-in-place process. For instance, if the caustic return valve 42 closes well before the interface between the alkaline cleaning composition and the rinse water passes through the sensor device 76, it can be concluded that some alkaline cleaning composition is not being returned to the caustic tank 40 and will be sent to drain 70. Likewise, if the caustic return valve 42 closes well after the interface between the alkaline cleaning composition and the rinse water passes through the sensor device 76, it can be concluded that some rinse water is being sent to the caustic tank 40 and not to drain 70. One can then adjust the valve closing and opening times in the programmable logic controller 99 for a subsequent cleaning cycles such that alkaline cleaning composition and the rinse water are only sent to the caustic tank 40 and to drain 70 respectively.

By determining a circulation time of the alkaline cleaning composition from the beginning of the caustic wash step to an end time wherein the measurable physical property of the fluid in the fluid return conduit 18 has a different measured value than that measured for the alkaline cleaning composition, it is possible to determine an optimum closing time for the caustic return valve 42. In other words, the location of the interface between the alkaline cleaning composition and the rinse water as a function of time can be used to set the caustic return valve 42 and the drain valve 72 closing times such that the caustic return valve 42 closes at a time such that no rinse water enters the caustic tank 40 and no alkaline cleaning composition enters the drain 70.

The same methodology can be used determine the location of the interface between an acidic cleaning composition and the rinse water as a function of time. This data can be used to set the acid return valve 52 and the drain valve 72 closing times in the programmable logic controller 99 such that the acid return valve 52 closes at a time such that no rinse water enters the acid tank 50 and no acidic cleaning composition enters the drain 70.

The same methodology can be used determine the location of the interface between rinse water having suspended solids and clear rinse water as a function of time. As described above with reference to FIG. 1, certain clean-in-place systems use a "high solids rinse" step, where the rinse supply valve 64 remains open and the high solids fill valve 22 is opened to allow solids in the apparatus 14 to be pushed into the high solids tank 20 by way of the rinse water. In a subsequent "first rinse" step, the rinse supply valve 64 remains open, the high solids fill valve 22 is closed, and the drain valve 72 is opened to allow rinse water to be pushed into the drain 70 by way of rinse water. Data from the processor 78 can be used to determine the location of the interface between rinse water having suspended solids and clear rinse water. The data is then used to set the high solids fill valve 22 and the drain valve 72 closing times in the programmable logic controller 99 such that the high solids fill valve 22 closes at a time such that excessive rinse water does not enter the high solids tank 20 and excessive solids do not enter the drain 70 of remain in the clean-in-place system for subsequent introduction into the caustic tank 40. This methodology allows for selection of rinse steps of sufficient duration to clean solids from the apparatus 14 yet avoid returning excessive solids to the caustic tank 40.

The location as a function of time of any interface between any two fluids having at least one differing measurable physical property can be determined from the fluid in the fluid return conduit 18 as the fluid passes through the sensor device 76 in a first cleaning cycle. For example, acid-water, base-water and acid-base interfaces can be determined from a change in pH or conductivity. Turbidity, suspended solids, concentration and density measurements may be used to determine interfaces between fluids having different solids levels. The opening and closing times of various valves in the programmable logic controller 99 can then be adjusted such that subsequent cleaning cycles return fluids to a desired receptacle (e.g., high solids tank 20, recovery tank 30, caustic tank 40, acid tank 50 or drain 70).

It is contemplated that direct feedback from the data processor 78 can be sent to the programmable logic controller 99 to provide opening and closing times for various valves in the clean-in-place system 12. For example, the detection of a flow rate and an interface between an acidic cleaning composition and the rinse water in the sensor device can provide control signals to the programmable logic controller 99 to close the acid return valve 52 in a calculated period of time and to open the drain valve 72 in another calculated period of time such that minimal rinse water enters the acid tank 50 and minimal acidic cleaning composition enters the drain 70. The same methodology would work for any other interface and associated valves (e.g., the interface between an alkaline cleaning composition and the rinse water in the sensor device can provide control signals to the programmable logic controller 99 to close the caustic return valve 42 in a calculated period of time and to open the drain valve 72 in another calculated period of time such that minimal rinse water enters the caustic tank 40 and minimal alkaline cleaning composition enters the drain 70).

Thus, there has been provided a monitoring device and monitoring methods for a clean-in-place system wherein the device and methods improve the cleaning of solids from the apparatus being cleaned, minimize water or sewer charges, limit the introduction of caustic or acidic compositions to the clean-in-place system drain, and limit the introduction of rinse water to the clean-in-place system cleaning composition tanks.

Although the present invention has been described in considerable detail with reference to certain embodiments, one skilled in the art will appreciate that the present invention can be practiced by other than the described embodiments, which have been presented for purposes of illustration and not of limitation. Therefore, the scope of the appended claims should not be limited to the description of the embodiments contained herein.

What is claimed is:

1. A method for cleaning an apparatus using a: clean-in-place system, the clean-in-place system being in fluid communication with an inlet of the apparatus and the clean-in-place system being in fluid communication with an outlet of the apparatus, the method comprising:

supplying a cleaning composition from a cleaner tank of the clean-in-place system into the inlet of the apparatus for a first period of time of a first cleaning cycle, the cleaning composition having a measurable physical property at a first measured value, the cleaner tank having a cleaner supply valve and a cleaner return valve such that the cleaning composition can be recirculated through the cleaner tank and the apparatus to clean the apparatus;

supplying a rinsing composition from a rinse tank of the clean-in-place system into the inlet of the apparatus for a second period of time of the first cleaning cycle, the rinsing composition having the measurable physical property at a second measured value different from the first measured value;

sensing the measurable physical property versus time for fluids exiting the outlet of the apparatus;

determining a circulation time of the cleaning composition from a selected time of the first period of time of the first cleaning cycle to an end time wherein the measurable physical property of the fluids has a third measured value different from the first measured value; and determining a cleaner return valve closing time for closing the cleaner return valve after supplying the cleaning composition from the cleaner tank and thereafter supplying the rinsing composition from the rinse tank in a subsequent cleaning cycle, the cleaner return valve closing time being selected in dependence on the determined circulation time.

2. The method of claim 1 wherein:

the cleaner return valve closing time is selected such that no rinsing composition enters the cleaner tank during the subsequent cleaning cycle.

3. The method of claim 1 wherein:

the measurable physical property is selected from the group consisting of pH, conductivity, turbidity, suspended solids, concentration, density and temperature.

4. The method of claim 1 wherein:

the measurable physical property is pH.

5. The method of claim 1 wherein:

the measurable physical property is conductivity.

6. The method of claim 1 wherein:

the measurable physical property is turbidity.

7. The method of claim 1 wherein:

the cleaning composition is an alkaline solution, the rinsing composition is water, and the measurable physical property is pH or conductivity.

8. The method of claim 1 wherein:

the cleaning composition is an acidic solution, the rinsing composition is water, and the measurable physical property is pH or conductivity.

9. A method for cleaning an apparatus using a clean-in-place system, the clean-in-place system being in fluid communication with an inlet of the apparatus and the clean-in-place system being in fluid communication with an outlet of the apparatus, the method comprising:

supplying a cleaning composition from a cleaner tank of the clean-in-place system into the inlet of the apparatus for a first period of time of a first cleaning cycle, the cleaning composition having a measurable physical property at a first measured value, the cleaner tank having a cleaner supply valve and a cleaner return valve such that the cleaning composition can be recirculated through the cleaner tank and the apparatus to clean the apparatus, the cleaner tank being in fluid communication with a drain of the clean-in-place system, the drain having a closed drain inlet valve;

supplying a rinsing composition from a rinse tank of the clean-in-place system into the inlet of the apparatus for a second period of time of the first cleaning cycle, the rinsing composition having the measurable physical property at a second measured value different from the first measured value;

sensing the measurable physical property versus time for fluids exiting the outlet of the apparatus;

determining a circulation time of the cleaning composition from a selected time of the first period of time of the first cleaning cycle to an end time wherein the measurable physical property of the fluids has a third measured value different from the first measured value; and determining a drain valve opening time for opening the drain valve after supplying the cleaning composition from the cleaner tank and thereafter supplying the rinsing composition from the rinse tank in a subsequent cleaning cycle, the drain valve opening time being selected in dependence on the determined circulation time.

10. The method of claim 9 wherein:

the drain valve opening time is selected such that no cleaning composition enters the drain during the subsequent cleaning cycle.

11. The method of claim 9 wherein:

the measurable physical property is selected from the group consisting of pH, conductivity, turbidity, suspended solids, concentration, density and temperature.

12. The method of claim 9 wherein:

the measurable physical property is pH.

13. The method of claim 9 wherein:

the measurable physical property is conductivity.

14. The method of claim 9 wherein:

the measurable physical property is turbidity.

15. The method of claim 9 wherein:

the cleaning composition is an alkaline solution, the rinsing composition is water, and the measurable physical property is pH or conductivity.

16. The method of claim 9 wherein:

the cleaning composition is an acidic solution, the rinsing composition is water, and the measurable physical property is pH or conductivity.

17. A method for cleaning an apparatus using a clean-in-place system, the clean-in-place system being in fluid communication with an inlet of the apparatus and the clean-in-place system being in fluid communication with an outlet of the apparatus, the method comprising:

circulating a cleaning composition from a cleaner tank of the clean-in-place system into the apparatus to clean the apparatus;

supplying a rinsing composition from a rinse tank of the clean-in-place system into the inlet of the apparatus for a period of time, the rinsing composition having a measurable physical property at a first measured value, the rinse tank having a rinse supply valve, the rinse tank being in fluid communication with a drain or a solids recovery tank of the clean-in-place system;

sensing the measurable physical property versus time for fluids exiting the outlet of the apparatus;

determining a circulation time of the rinsing composition from a selected time of the period of time to an end time wherein the measurable physical property of the fluids is approximately the first measured value; and determining a rinsing time for opening the rinse supply valve and supplying the rinsing composition from the rinse tank in a subsequent cleaning cycle, the rinsing time being selected in dependence on the determined circulation time.

18. The method of claim 17 wherein:

the rinsing time is selected such that loose solids present in passageways of the apparatus enter the drain or the solids recovery tank during the subsequent cleaning cycle.

19. The method of claim 17 wherein:

the measurable physical property is selected from the group consisting of pH, conductivity, turbidity, suspended solids, concentration, density and temperature.

20. The method of claim 17 wherein:

the measurable physical property is conductivity.

21. The method of claim 17 wherein:

the measurable physical property is turbidity.

22. The method of claim 17 wherein:

the rinsing composition is water and the measurable physical property is conductivity or turbidity.

* * * * *